United States Patent [19]

Shida

[11] 4,278,051

[45] Jul. 14, 1981

[54] METHOD OF PREVENTING RECIRCULATION PUMP CAVITATION AND FORCED RECIRCULATION PUMP TYPE STEAM-GENERATING APPARATUS USING THE METHOD

[75] Inventor: Toichi Shida, Hitachi, Japan

[73] Assignee: Hitachi, Ltd., Tokyo, Japan

[21] Appl. No.: 25,575

[22] Filed: Mar. 30, 1979

[30] Foreign Application Priority Data

Apr. 5, 1978 [JP] Japan ..... 53-39192

[51] Int. Cl.[3] ..... F22D 7/00

[52] U.S. Cl. ..... 122/406 A; 415/1; 417/18; 122/406 R

[58] Field of Search ..... 122/406 R, 406 A, 488; 415/1, 17; 417/18, 32

[56] References Cited

U.S. PATENT DOCUMENTS

| | | | |
|---|---|---|---|
| 2,613,655 | 10/1952 | Waeselynck | 122/406 A |
| 2,849,989 | 9/1958 | Vorkanf | 122/406 R |
| 3,617,151 | 11/1971 | Scroggins | 417/18 |
| 4,003,671 | 1/1977 | Huse et al. | 415/1 |

*Primary Examiner*—Henry C. Yuen

*Attorney, Agent, or Firm*—Craig and Antonelli

[57] ABSTRACT

A method of preventing a recirculation pump cavitation and a forced recirculation type steam-generating apparatus are disclosed in which water is forcibly circulated by a recirculation pump. The pressure of the steam-generating section of the steam-generating apparatus and the temperature of water at the suction side of the recirculation pump are detected. The rotational speed of the recirculation pump is reduced to a predetermined speed level when the difference between the saturation temperature associated with the detected pressure and the water temperature is reduced below a predetermined value, thus preventing the cavitation which otherwise might occur in the recirculation pump.

6 Claims, 3 Drawing Figures

METHOD OF PREVENTING RECIRCULATION PUMP CAVITATION AND FORCED RECIRCULATION PUMP TYPE STEAM-GENERATING APPARATUS USING THE METHOD

BACKGROUND OF THE INVENTION

1. Field Of The Invention

The present invention relates to a forced recirculation type steam-generating apparatus, or more in particular to a method of preventing the recirculation pump cavitation which otherwise might occur in the recirculation pump when the pressure in the steam-generating section of the reactor or a circulation type boiler is steeply reduced and the forced recirculation type steam-generating apparatus using the same method.

2. Description Of The Prior Art

In the conventional reactor and the like, the cavitation in the recirculation pump and jet pump has been prevented by a method of detecting the reduction of water supply, thus generating a cavitation preventing signal, by the use of which the recirculation flow is reduced or another method of monitoring the difference in temperature between the main steam and the recirculation water, thus generating a cavitation preventing signal, when the temperature difference is reduced below a predetermined value, by the use of which the recirculation flow is reduced. In the former method, the cavitation is likely to occur due to the steep pressure reduction caused by the trouble of the pressure control device. The latter method, on the other hand, has the disadvantage that the response of the detector for detecting the temperature of the main steam line is so slow that the operation for reducing the recirculation flow is delayed at the time of steep pressure drop in the reactor, thus providing unsatisfactory means for preventing the recirculation pump cavitation.

SUMMARY OF THE INVENTION

An object of the present invention is to provide a method of preventing the recirculation pump cavitation which has overcome the above-mentioned shortcomings in the prior art, and a forced recirculation type steam-generating apparatus using the same method.

Acording to the present invention, there is provided a forced recirculation type steam-generating apparatus in which the water in the steam-generating apparatus is forcibly circulated with a pump, comprising means for detecting the pressure in the steam-generating section of the steam-generating apparatus, means for generating a saturation temperature corresponding to the pressure detected by the pressure detector means, means for detecting the temperature of the water at the pump suction side, and means for generating a signal for reducing the recirculation flow by the pump when the difference between the saturation temperature and the temperature detected by the temperature detector means is reduced below a predetermined value.

DESCRIPTION OF THE PREFERRED EMBODIMENTS

Figure 1:
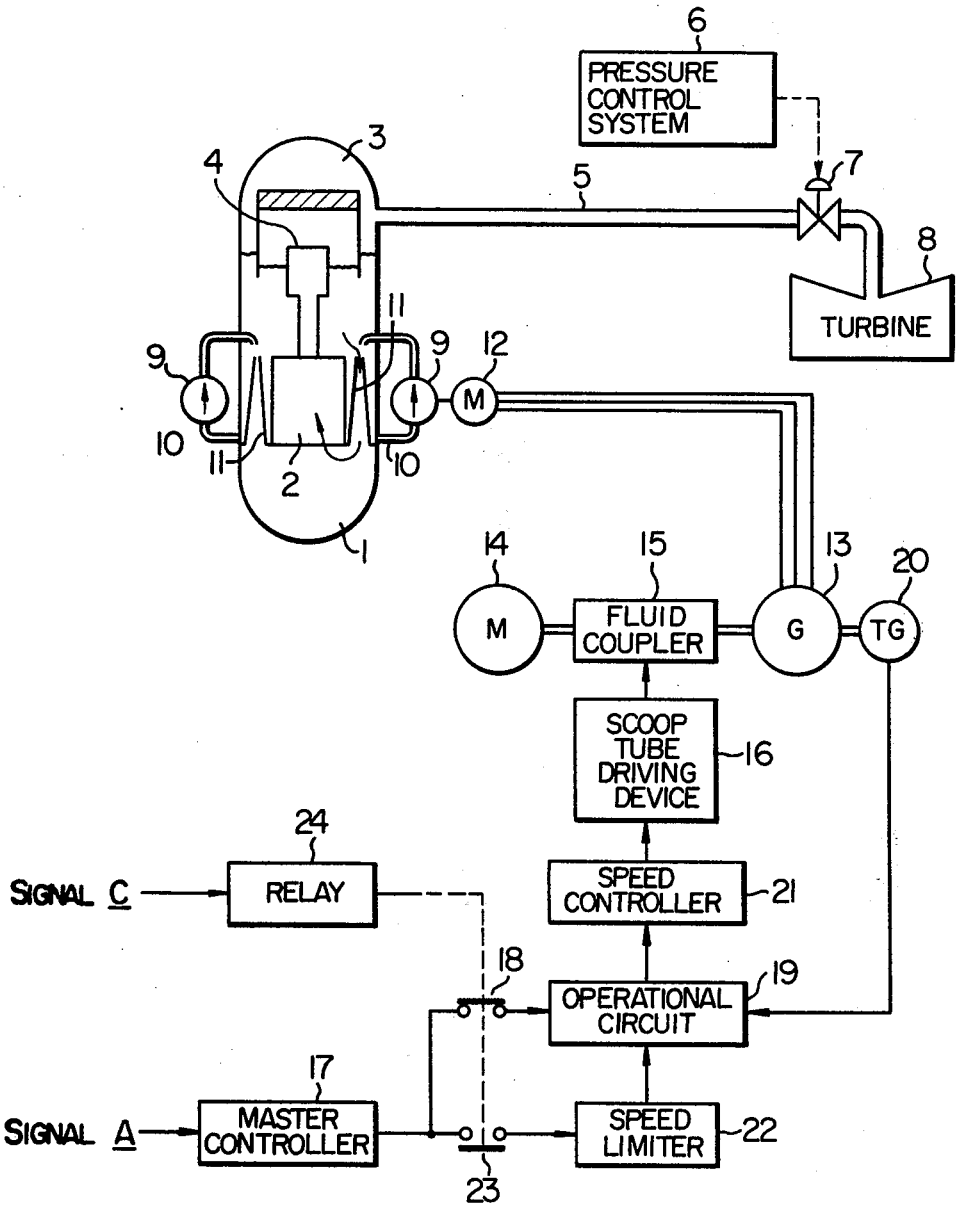
FIG. 1 is a block diagram schmatically showing a reactor and a recirculation flow control system for controlling the recirculation flow.
Figure 2:
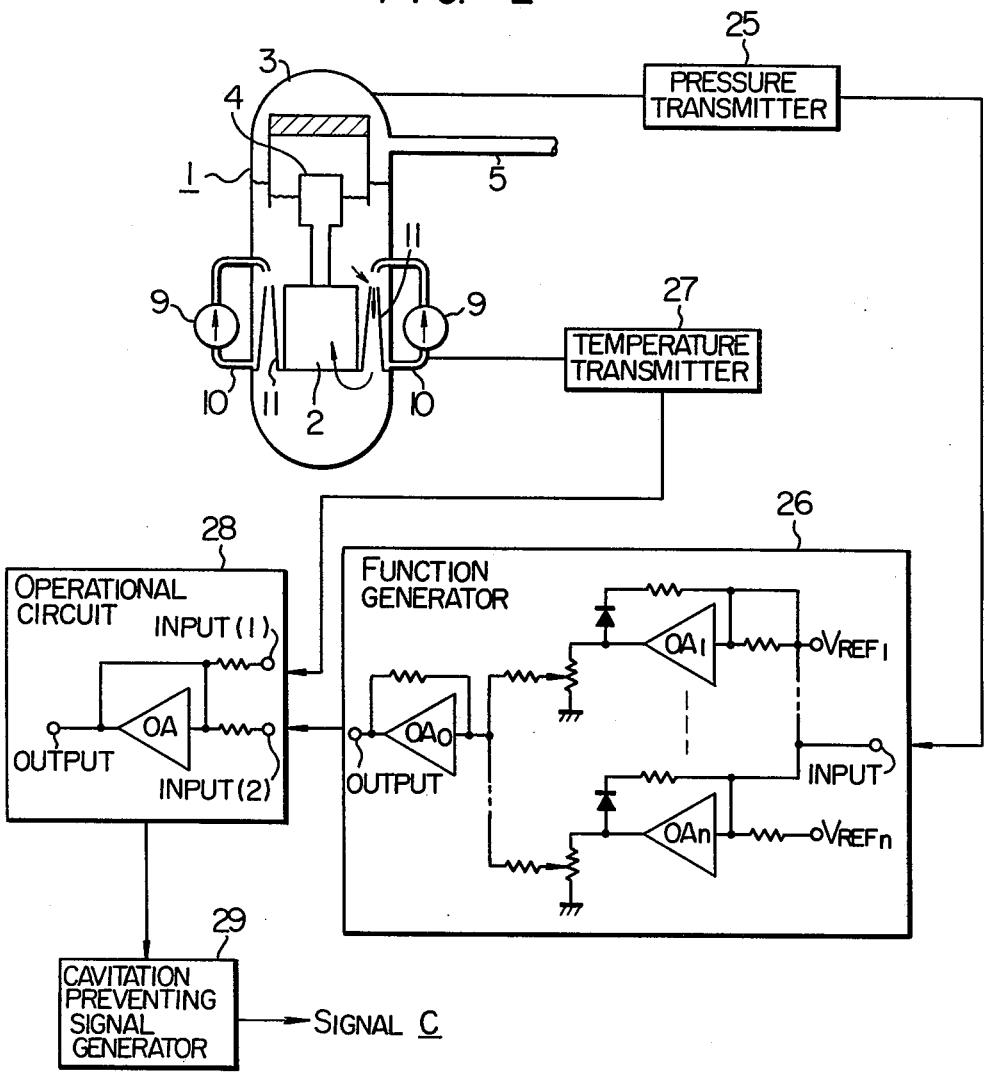
FIG. 2 is a block diagram showing a circuit for generating a signal for reducing the recirculation flow in accordance with both of the detected recirculation water temperature signal and the detected reactor pressure signal according to an embodiment of the present invention.

An embodiment of the present invention will be described in detail below with reference to the accompanying drawings. Embodiments of the present invention adapted for the boiling water reactor are shown in FIGS. 1 and 2. Reference numeral 1 designates a reactor vessel, numeral 2 a core, numeral 3 a reactor dome plenum (hereinafter referred to as steam-generating section), and numeral 4 a steam separator. The steam generated at the steam-generating section 3 is supplied to a turbine 8 through a main steam line 5 and a turbine regulating valve 7 the opening of which is controlled by a pressure control system 6. When the recirculation flow of the water taken in at the suction port 10 is fed through a jet pump 11 to the core 2, the core flow is changed accordingly, so that the void amount in the core changes temporarily, thus making it possible to change the output of the reactor. The recirculation pump 9 is directly coupled to an induction motor 12 which uses a variable frequency motor generator set (hereinafter referred to as MG set) as a power supply therefor. The MG set is provided with an AC generator 13 and an induction motor 14 coupled to each other through a fluid coupler 15. The fluid coupler 15 includes a scoop tube (not shown). The slip between the input and output shafts of the fluid coupler 15 is regulated by changing the position of the scoop tube, so that the frequency of the output of the AC generator is changed in the range of about 9 Hz to 47 Hz, thus controlling the rotational speed of the recirculation pump 9. The positioning regulation of the scoop tube is performed by means of a scoop tube driving device 16 and an analog control circuit as described below. A load demand signal A is applied to a main controller 17 from the turbine control system. The output signal of the master controller 17 is applied to the operational circuit 19 through the b-contact 18 of the relay 24 described later. The operational circuit 19 is also impressed with a feedback signal from the tachometer generator (TG) 20 for measuring the speed of the generator 13. The error signal between the output signal of the master controller 17 and the feedback signal of the tachometer generator 20 is produced from the operational circuit 19 and applied to a speed controller 21 constituted by a proportional integrator. The output signal of the speed controller 21 is applied as a control signal of the rotational speed of the AC generator to the scoop tube driving device 16 for regulating the position of the scoop tube, thereby controlling the rotational speed of the AC generator. Numeral 22 designates a speed limiter inserted between the master controller 17 and the operational circuit 19. The speed limiter 22 is normally bypassed by the b-contact 18 of the relay 24, and adapted to be inserted in the speed control signal path through the a-contact 23 of the relay 24 upon energization of the relay 24. The insertion of the speed limiter 22 in the signal path causes the recirculation flow to be reduced. The speed of the recirculation pump 9 may be reduced to, for example, about 30% of the normal operation speed. The relay 24 is adapted to operate in response to the cavitation preventing signal C from the cavitation preventing signal generator 29 as described later.

In FIG. 2, the pressure in the reactor vessel 1 is detected by used of the pressure detector 25 such as a pressure transmitter. An electrical signal corresponding to the detected pressure is produced and applied to a function generator 26, which produces an electrical signal representing the saturation temperature corresponding to the pressure signal applied thereto. A temperature detector 27 such as a temperature transmitter detects the temperature of the recirculation water at the suction side 10 of the recirculation pump 9 and produces an electrical signal corresponding to the detected temperature. The operational circuit 28 determines the difference between the output signal of the function generator 26 and the output signal of the temperature detector 27, and applies the error signal to the cavitation preventing signal generator 29. When the error signal produced from the operational circuit 28 is reduced below a predetermined temperature difference, the cavitation preventing signal generator 29 decides that a recirculation pump cavitation is likely to occur, in which case the cavitation preventing signal C is applied to the relay 24 to reduce the recirculation flow. In response to the cavitation preventing signal C, the relay 24 opens the b-contact 18 while at the same time closing the a-contact 23 and thus inserts the speed limiter 22 in the speed control signal path, so that the rotational speed of the recirculation pump is reduced to about 30% of the normal operation speed, thus reducing the recirculation flow.

In this embodiment, a trouble of the pressure control system 6 causes the turbine regulating valve 7 to fully open, resulting in a sharp drop of the pressure of the reactor. This causes a sharp drop in the net positive suction head (NPSH) at the suction port of the recirculation pump 9 which stands at about 83 meters in the operation at rated pressure. This pressure drop is detected by the pressure detector 25 and reduces the output of the function generator 26 accordingly. If, as a result, the error signal produced from the operational circuit 28 is reduced below a predetermined temperature difference, say, about 5° C, the cavitation preventing signal generator 29 produces the cavitation preventing signal C. In response to this cavitation preventing signal C, the relay 24 is actuated, so that the b-contact 18 thereof opens while the a-contact 23 thereof closes.

The above-mentioned method of preventing the recirculation pump cavitation is based on the principle described below. In view of the fact that the sum of the static pressure and dynamic pressure of the fluid, i.e., total pressure is constant, reduction in the rotational speed of the recirculation pump causes reduction in the flow rate and hence dynamic pressure. The result is that the static pressure increases and the saturation temperature corresponding thereto also increases. Therefore, if the temperature of the water at the suction side of the recirculation pump is maintained below the saturation temperature corresponding to the static pressure of the water, the cavitation in the pump will be prevented. However, in the case where the static pressure of the water at the suction side of the recirculation pump is reduced by the decrease in the pressure of the steam-generating section, the recirculation pump cavitation is likely to occur if the water temperature remains unchanged but NPSH is reduced. Therefore, by reducing the rotational speed of the recirculation pump, the flow rate of the water at the suction side thereof is reduced. Thus, the static pressure is increased, thereby preventing the occurrence of the recirculation pump cavitation.

According to the present invention, the pressure instead of the temperature of the steam-generating section is detected by the systems interlocked for preventing the recirculation pump cavitation. This improves responsiveness and makes possible immediate detection of the change of NPSH at the time of sharp reduction in pressure, thus enabling more effective prevention of the recirculation pump cavitation by the recirculation flow controller at the time of pressure drop.

Figure 3:
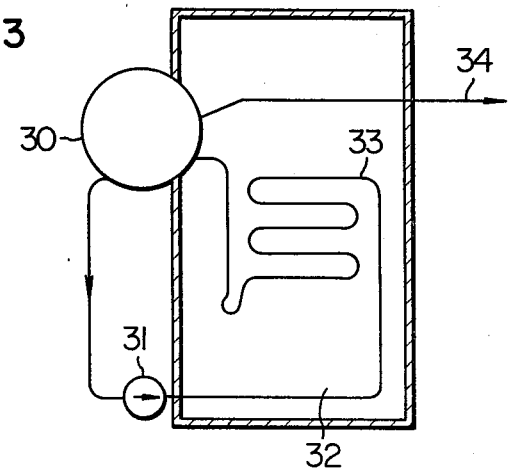
FIG. 3 is a schematic diagram showing a well-known circulation type boiler.

A well-known circulation type boiler is shown schematically in FIG. 3. The water from the steam drum 30 is forcibly circulated by the circulation pump 31 in the water tube 33 arranged in the combustion chamber 32. Numeral 34 designates a steam line. The present invention may be embodied also in such an ordinary circulation boiler.

According to the present invention, the pressure of the steam-generating section is detected in order to determine the possibility of occurence of the cavitation, making possible a rapid response as compared with the conventional apparatus detecting the steam temperature. As a result, the recirculation flow is rapidly reduced at the time of steep pressure drop of the reactor, thereby preventing the cavitation from occurring more accurately.

I claim:

1. A forced recirculation type steam-generating apparatus in which water therein is circulated forcibly by a pump, comprising:

(a) a steam-generating section;

(b) means for detecting pressure in said steam-generating section;

(c) means for generating a saturation temperature corresponding to the pressure detected by said pressure detector means;

(d) means for detecting a temperature of water at a suction side of said pump; and (e) means for generating a signal for reducing a rotational speed of said pump when a difference between said detected temperature and said saturation temperature is reduced below a predetermined temperature level, whereby a recirculation flow by said pump is reduced.

2. A forced recirculation type steam-generating apparatus according to claim 1, wherein said pressure detector means includes a pressure transmitter for converting the detected pressure into a first electrical signal, said temperature detector means includes a temperature transmitter for converting the detected temperature into a second electrical signal, said saturation temperature generator means includes a function generator for generating a third signal associated with the saturation temperature in accordance with said first electrical signal, said means for generating a signal for reducing the recirculation flow includes an operational circuit for generating a fourth electrical signal for reducing the rotational speed of said pump to a predetermined level when a difference between said second electrical signal and said third electrical signal is reduced below a predetermined value.

3. A forced recirculation type steam-generating apparatus according to claim 1, wherein the rotational speed of said pump is reduced to approximately 30% of normal operation speed when said predetermined temperature difference is reduced to about 5° or below.

4. A forced recirculation type steam-generating apparatus in which water therein is forcibly circulated with a pump, said apparatus including a steam generating section, a drive control device for said pump, and a cavitation preventing signal generator for said pump, (a) said pump drive control device comprising: a first motor for driving said pump; an AC generator for supplying an electric power to said first motor; a second motor for driving said generator; a fluid coupler for mechanically coupling said generator and said second motor, said fluid coupler changing the degree of coupling therebetween, thereby to control the fequency of the output of said AC generator; a scoop tube the position of which is adapted to be changed thereby to control a degree of coupling of said fluid coupler; a scoop tube drive means for controlling the position of said scoop tube; a speed controller for generating a signal for controlling said scoop tube drive means thereby to control the rotational speed of said AC generator; a tachometer generator for detecting the rotational speed of said AC generator; a master controller for generating a rotational speed setting signal for said pump in accordance with a load demand signal; a relay having a first and a second contact; and an operational circuit having a reversible input terminal and a non-reversible input terminal, one of said input terminals being connected with the output of said tachometer generator, the other of said input terminals being connected with the output of said master controller through a speed limiter when said first contact of said relay is closed and said second contact thereof is opened, the other of said input terminals being connected directly with the output of said master controller when said first contact is opened and said second contact is closed, thus supplying an error signal to said speed controller, and (b) said cavitation preventing signal generator comprising: a pressure transmitter for converting pressure in said steam-generating section of said steam-generating apparatus into a first electrical signal; a temperature transmitter for converting a water temperature at the suction side of said pump into a second electrical signal; a function generator for generating a third electrical signal corresponding to the saturation signal in accordance with said first electrical signal produced from said pressure transmitter; and an operational circuit for generating a signal for closing said first contact and opening said second contact of said relay when the difference between said second and third electrical signals is reduced below a predetermined value, thereby reducing the recirculation flow by said pump.

5. A method of preventing the recirculation pump cavitation of a steam-generating apparatus, comprising the steps of:

(a) detecting pressure in the steam-generating section of said steam-generating apparatus;

(b) detecting a temperature of water at a suction side of said recirculation pump;

(c) generating a saturation temperature associated with said detected pressure; and (d) reducing the rotational speed of said recirculation pump to a predetermined level when a difference between said detected temperature and said saturation temperature is reduced below a predetermined value, thereby reducing the recirculation flow by said pump.

6. A method of preventing the cavitation according to claim 5, wherein said predetermined temperature value is set at 5° C and said predetermined speed level is set at 30% of a normal operation speed.

* * * * *